United States Patent [19]

Helton

[11] Patent Number: 4,974,688

[45] Date of Patent: Dec. 4, 1990

[54] STEERABLE EARTH BORING DEVICE

[75] Inventor: Gary B. Helton, Danville, Ind.

[73] Assignee: Public Service Company of Indiana, Inc., Plainfield, Ind.

[21] Appl. No.: 378,065

[22] Filed: Jul. 11, 1989

[51] Int. Cl.[5] ..... E21B 7/08; E21B 10/44

[52] U.S. Cl. ..... 175/73; 175/61; 175/323; 175/382; 175/394

[58] Field of Search ..... 175/74, 73, 61, 62, 175/323, 382, 384, 394

[56] References Cited

U.S. PATENT DOCUMENTS

| | | | |
|---|---|---|---|
| 3,326,008 | 6/1967 | Baran et al. | 175/73 |
| 3,526,285 | 9/1970 | Adkins et al. | 175/73 |
| 3,565,190 | 2/1971 | Ishii | 175/171 |
| 3,743,034 | 7/1973 | Bradley | 175/73 |
| 4,013,134 | 3/1977 | Richmond et al. | 175/73 |
| 4,026,371 | 5/1977 | Takada et al. | 175/73 X |
| 4,342,346 | 8/1977 | Capoccia | 175/73 |
| 4,374,547 | 2/1983 | Nguyen et al. | 175/45 |
| 4,396,073 | 8/1983 | Reichman et al. | 175/74 |
| 4,571,122 | 2/1986 | Yamamoto et al. | 175/62 X |
| 4,655,299 | 4/1987 | Schoeffler | 175/38 |
| 4,674,579 | 6/1987 | Geller et al. | 175/45 |
| 4,714,118 | 12/1987 | Baker et al. | 175/26 |
| 4,787,463 | 11/1988 | Geller et al. | 175/45 |

FOREIGN PATENT DOCUMENTS

| | | | |
|---|---|---|---|
| 3505505 | 8/1986 | Fed. Rep. of Germany | 175/62 |
| 229397 | 3/1969 | U.S.S.R. | 175/73 |

*Primary Examiner*—Hoang C. Dang

*Attorney, Agent, or Firm*—Woodard, Emhardt, Naughton Moriarty & McNett

[57] ABSTRACT

A steerable earth boring device comprises a compaction auger rotatably mounted to a housing at one end of the auger such that the compaction auger is substantially externally exposed. A steering tip is pivotably disposed at the other end of the compaction auger for providing steering control for the earth boring device. An internally housed steering mechanism is provided for pivoting the steering tip relative to the compaction auger while the auger is rotating. The steering mechanism includes a non-rotatable cam disposed within and pivotably connected to the housing and a follower rotatable with and pivotable relative to the compaction auger. The cam and follower contact at a bearing surface so that pivoting motion of the cam is transmitted to the rotatable follower. A control member is connected between the follower and the steering tip, extending through the compaction auger, to transmit pivoting of the follower to pivoting of the steering tip.

12 Claims, 4 Drawing Sheets

STEERABLE EARTH BORING DEVICE

BACKGROUND OF THE INVENTION

The present invention relates to the field of earth boring and, more particularly, the directional control of horizontal earth boring tools.

It has long been recognized by utility companies that installing utility lines underground is safer and more esthetically pleasing, generally producing less of an environmental impact than above-ground or excavated trench type installation methods. The most common means of installing underground lines by the cut and cover technique where a ditch is first dug in the area, the utility line is installed, and the ditch covered. While the cut and cover technique is satisfactory for new construction areas, built up areas of existing construction require a different method so as not to disturb the existing structures and traffic areas.

Consequently, a number of earth boring devices have been proposed for boring through unconsolidated material such as soil. Previous horizontal boring equipment has been plagued with the serious problem of the inability to exercise adequate control over the direction of the drill string. Thus, many prior art devices have lacked the capability of redirecting the drill string along the proper horizontal path should it deviate from that correct path. Moreover, many of the prior art devices lack optimum abilities to advance around a curve.

In one such earth boring device of the prior art, a high pressure fluid is conveyed to an angled nozzle to a section of rotating pipe. Fluid ejected from the nozzle performs the earth boring operation. When the tool is to be advanced around a curve, rotation of the pipe is stopped so that the angled nozzle is pointed in the proper direction. The tool is then pushed without rotation until the proper amount of curvature is obtained. The patent to Geller, et al., U.S. Pat. No. 4,787,463, is representative of this type of earth boring device.

In another earth boring device of the prior art, as represented by the patent to Adkins, et al. U.S. Pat. No. 3,526,285, a horizontal auger includes a tilting auger head which carries a pilot bit. The tilting of the auger head is achieved by use of a wobble plate and universal joint assembly oriented on a casing surrounding the auger itself. During the boring operation, earth is carried conveyed by the auger blades through the casing. When it is necessary to change the direction of the auger earth boring device, the wobble plate is tilted about a single axis so that the auger head and pilot bit are also tilted. In order to achieve multiple degree of freedom movement of the earth boring device, it is necessary that the auger casing be rotated to an appropriate position to re-orient the wobble plate tilt axis thereby controlling the direction of motion of the boring device.

None of the above described devices provides a mechanical direction control for a steerable earth boring auger that is completely enclosed, rather than exposed to the earth during the boring operation. There is a need for providing a reliable steering mechanism for a steerable earth boring device, that utilizes mechanical forces, rather than fluid forces to perform the steering operation. There is also a need for a device that permits multiple degree of freedom tilting or steering of the earth boring auger in a simple and easily maintained mechanism.

SUMMARY OF THE INVENTION

These and other objects and benefits are provided by a steerable earth boring device comprising a compaction auger rotatably mounted to a housing at one end of the auger such that the compaction auger is substantially externally exposed. A steering tip is pivotably disposed at the other end of the compaction auger for providing steering control for the earth boring device. Steering means are provided for pivoting the steering tip relative to the compaction auger while the auger is rotating. In one aspect of the invention, the pivoting of the steering tip is controlled by steering means including a non-rotatable cam disposed within and pivotably connected to the housing and a follower rotatable with and pivotable relative to the compaction auger. The cam and follower contact at a bearing surface so that pivoting motion of the cam is transmitted to the rotatable follower. A control member is connected between the follower and the steering tip, extending through the compaction auger, to transmit pivoting of the follower to pivoting of the steering tip.

In another aspect of the invention, a steerable earth boring device includes a housing and an auger rotatably mounted to the housing at one end of the auger. A steering tip is pivotably disposed at the other end of the auger and includes a jet orifice for directing a high pressure fluid to assist in the earth boring operation. Means are included for providing the high pressure fluid from the housing, through the rotating auger and steering tip to the jet orifice.

In yet another aspect of the invention, a steerable earth boring device comprises a housing and an elongated auger rotatable about a longitudinal axis of the auger and rotatably mounted to the housing at one end of the auger. A steering tip is disposed at the other end of the auger and pivotable relative to the longitudinal axis of the auger. Means are provided, disposed between the housing and the steering tip, for pivoting the tip relative to the housing about at least two non-colinear axes perpendicular to the longitudinal axis, thereby pivoting the tip relative to the longitudinal axis.

It is one object of the present invention to provide a steerable earth boring device in which the steering components are not exposed to the earth during the boring operation. Another object is to provide such a device having a mechanically simple yet reliable mechanism for steering the boring device. These and other objects and benefits of the invention will become apparent through the following disclosure and accompanying drawings.

DESCRIPTION OF THE PREFERRED EMBODIMENTS

Figure 1:
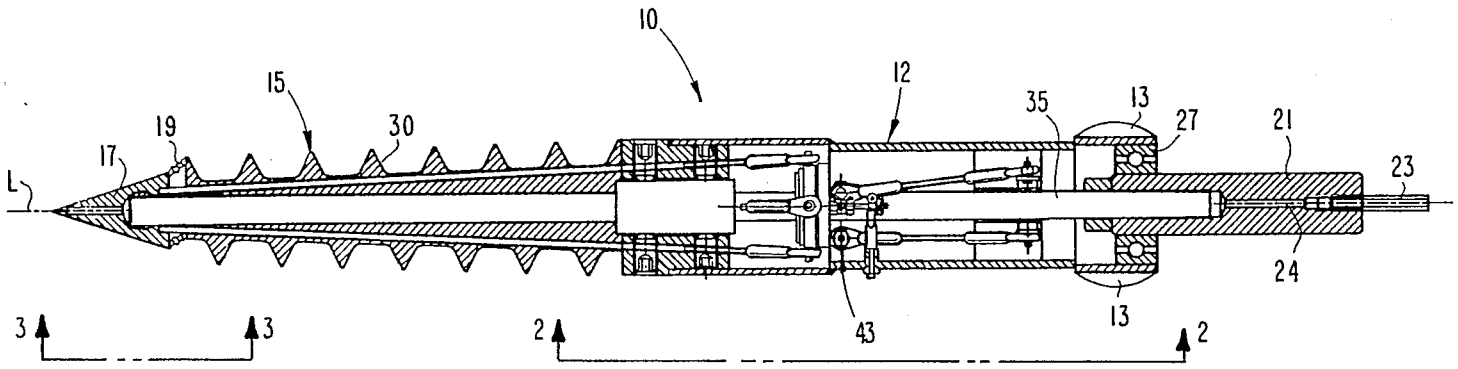
FIG. 1 is a partial cross-sectional view of the steerable earth boring device of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated devices, and such further applications of the principles of the invention as illustrated therein being contemplated as would normally occur to one skilled in the art to which the invention relates.

A steerable earth boring device 10 comprises a non-rotating housing assembly 12. The housing assembly fully encloses the primary components of the steering mechanism so that the components are not exposed to the earth during the boring operation. A number of fins 13 project from the proximal end of the housing. The fins react against the earth as the auger is rotated to prevent the non-rotating housing from rotating during the boring operation. A rotating compaction auger assembly 15 is supported at the distal end of the housing 12 and is substantially exposed external to the housing to compact the earth around the earth boring device during operation of the device. Disposed at the free end of the rotating compaction auger assembly 15 is a steering tip 17 that rotates with the auger assembly in the preferred embodiment, and is used to control the direction of motion of the earth boring device 10 through the earth. A flexible seal 19 is connected between the auger assembly 15 and the steering tip 17 to prevent infiltration or compaction of earth in the gap between the two components. The flexible seal 19 is preferably corrugated so that it flexes while the steering tip 17 is tilted relative to the compaction auger assembly 15.

Figure 2:
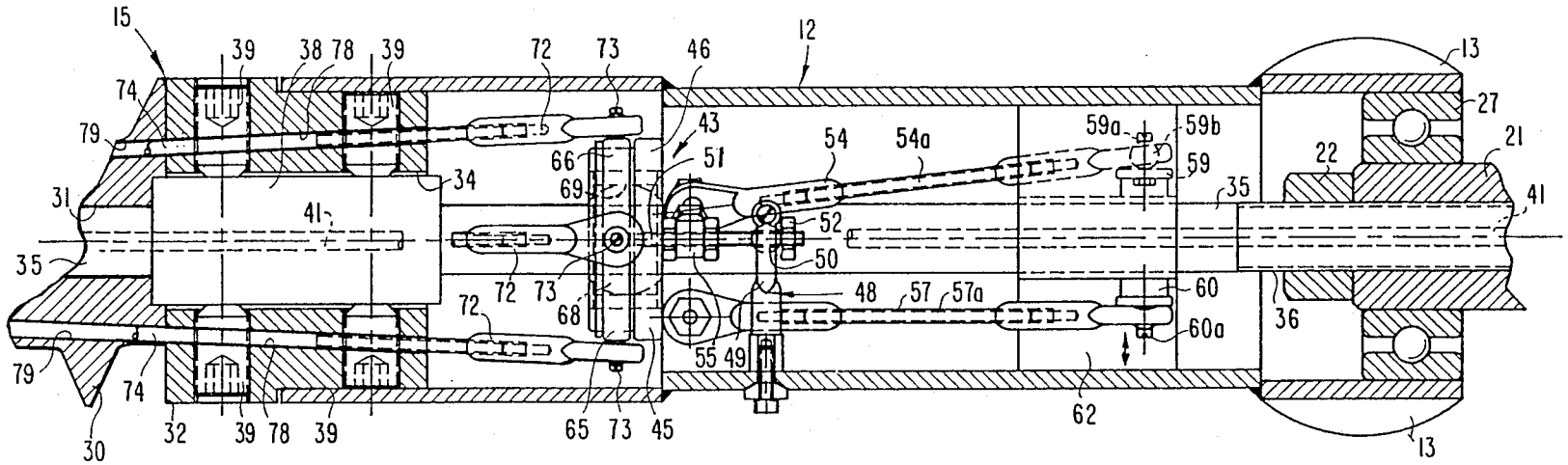
FIG. 2 is an enlarged partial cutaway cross-sectional view of the earth boring device of FIG. 1 as viewed in direction of the arrows of line 2—2.

Rotational motion is provided to the rotating auger assembly 15 by way of an input shaft 21 that is supported by a roller bearing 27 mounted within the non-rotating housing 12. Input shaft 21 can be part of a bendable drill string, or flexible shaft, each of which is known in the prior art. Connection of input shaft 21 to other components of the drill string can be made in accordance with methods known in the art. Since the rate of rotation of auger assembly 15 is low, rotation of the input shaft is also low so that none of the rotating components are subject to high rotational stresses. The input shaft includes a fluid line 23 that communicates with a bore 24 through the center of a shaft. The fluid line 23 and fluid channel 24 can be connected to a source of high pressure fluid, such as water, to facilitate the earth boring operation as described herein. A drive shaft 35 is connected to the input shaft 21. The drive shaft 35 extends through the non-rotating housing assembly 12 and the rotating auger assembly 15 and includes a fluid line 41 therethrough that communicates with channel 24 of the input shaft. The drive shaft 35 includes a first threaded end 36 (FIG. 2) for connecting the drive shaft 35 to the input shaft 21 by way of a nut 22 that is preferably welded to the input shaft 21. Alternatively the drive shaft 35 can include a spline interface between end 36 and nut 22 to permit axial motion of the shaft 35.

Figure 3:
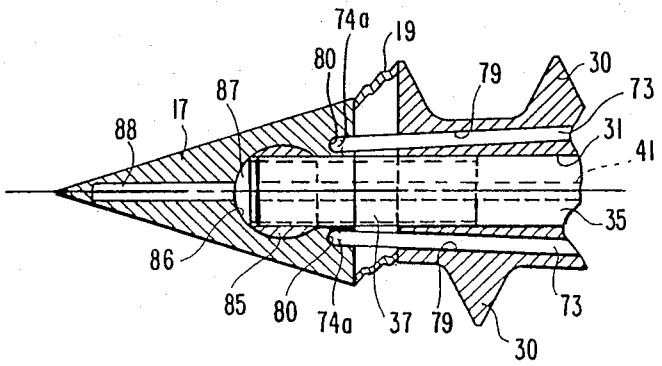
FIG. 3 is an enlarged partial cutaway cross-sectional view of the steering tip of the earth boring device of FIG. 1 as viewed in direction of the arrows of line 3—3.

The drive shaft 35 further includes a second threaded end 37, as shown in FIG. 3, for attaching the steering tip 17 and for transmitting rotational motion to the tip. Alternatively, the end 37 may form a spline connection. The rotating auger assembly 15 includes a compaction auger bit 30. The compaction auger bit 30 has a bore 31 extending through the entire length of the bit. The drive shaft 35 is press-fit into the bore 31 adjacent the second threaded end 37 of the shaft, so that rotation of the drive shaft 35 is directly transmitted to the auger bit 30. A seal 32 is provided between the auger bit 30 and the housing assembly 12 to close the end of the housing 12, to support the auger bit 30 and to act as a bearing surface for rotation of the auger bit relative to the non-rotating housing assembly 12. The drive shaft 35 includes a coupling portion 38 directly adjacent the seal 32. A number of set screws 39 extend through the seal and contact the coupling portion to rotationally connect the seal to the drive shaft.

The steerable earth boring device 10 includes a steering control assembly 43 that is fully contained within the non-rotating housing or rotating auger assemblies. The steering control assembly 43 includes a non-rotating mechanism 45 and a rotating mechanism 65. The non-rotating mechanism 45 includes a non-rotating swash plate 46 disposed about, but not rotating with, the drive shaft 35. The non-rotating swash plate 46 is held against rotation by a pivot support assembly 48. The pivot support assembly 48 includes a fixed arm 49 projecting from the inner surface of the non-rotating housing 12. Extending axially from the fixed arm 49 is a support rod 50 that is connected at its end to the non-rotating swash plate 46 by a ball and socket connection 51. The support rod 50 is only permitted to move axially relative to the fixed arm 49, which motion is limited by the stop 52 threaded on to the end of the support rod. The pivot support assembly 48 prevents the non-rotating swash plate 46 from rotating with the drive shaft 35. The support rod 50 also provides a pivot reaction point for the tilting of the non-rotating swash plate 46 as described herein.

In the preferred embodiment, a first linkage arm 54 and a second linkage arm 57 are connected to the non-rotating swash plate to provide the tilting motion for the plate. A first clevis 55 connects the first linkage arm 54 to the swash plate 46, while a second clevis 58 (FIG. 4) connects the second linkage arm 57 to a position approximately 90° from the first linkage arm connection. The other end of each of the linkage arms is connected to an actuator. The first linkage arm 54 is connected to an actuator 59 by way of a ball and socket **59*b* affixed to the push rod 59*a* of the actuator. The second linkage arm 57 is similarly connected to the rod 60*a* of actuator 60. Both actuators are fixedly mounted within the non-rotating housing assembly by way of an actuator support 62, so that neither linkage arm rotates with the drive shaft 35. The first and second linkage arms 54 and 57 are of conventional design in that they provide a connecting rod, 54*a* and 57*a*** respectively, that is threaded between the turn buckles to adjust the length of the linkage arm.

Figure 4:
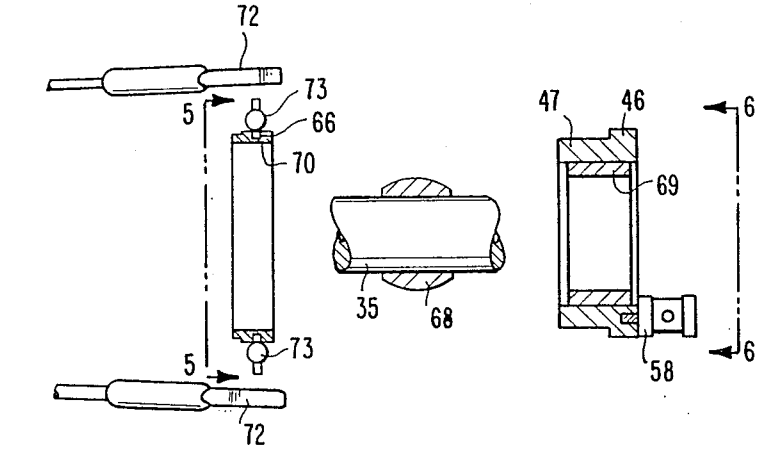
FIG. 4 is an enlarged partial exploded view of the rotating and non-rotating steering mechanisms for the earth boring device of the present invention.

The steering control assembly 43 further includes a rotating mechanism 65 comprising a rotating swash plate 66. As shown in more detail in FIG. 4, the rotating swash plate 66 is tilted by the tilting motion of the non-rotating swash plate 46. The rotating mechanism further includes a self-aligning spherical bearing 68 that is pressed over the shaft 35 directly beneath steering control assembly 43. A bearing race 69 is pressed into the non-rotating swash plate 46, as shown in FIG. 4 to provide a bearing surface for the rotation of the drive shaft beneath the non-rotating plate 46. The race 69 also provides a bearing surface for the tilting of the plate 46 relative to the bearing 68. The non-rotating swash plate 46 includes a drive flange 47 that projects axially forward of the non-rotating swash plate. The rotating swash plate 66 includes an inner bearing surface 70 that rides upon the surface of the drive flange 47 to permit the swash plate 66 to rotate relative to the non-rotating swash plate 46. As the first and second linkage arms 54 and 57 are stroked, the swash plate 66 pivots about the ball and socket connection 51 of the pivot arm 49 into a tilted attitude. The tilted attitude of the non-rotating swash plate 46 is conveyed to the rotating swash plate 66 by way of the drive flange 47. As the non-rotating swash plate 46 tilts, the bearing race 69 rides against the spherical bearing 68 to maintain the axial position of the steering control assembly 43.

Figure 5:
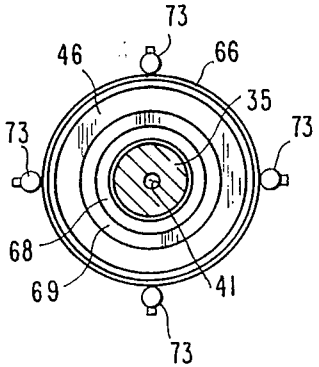
FIG. 5 is a front view of the steering mechanisms shown in FIG. 4 as viewed in direction of the arrows of line 5—5.

Referring again to FIG. 2, a number of control linkages 72, which in the preferred embodiment are linkages as shown in the figures, are connected by way of spherical mounts 73 to the rotating swash plate 66. In the preferred embodiment, as shown in FIG. 5, four control linkages 72 are disposed on four spherical mounts 73 situated at 90° intervals around the circumference of the rotating swash plate 66. Each of the control linkages 72 includes a control rod 74 that is threaded at one end and connected to a turn buckle in a typical fashion. Each of the control rods extends through a control rod bore 78 in the rotating seal 32. A second control rod bore 79 extends through the auger bit 30 to accommodate each of the four control linkage rods 74. Each of the four control rods 74 extends through each of the four bores 78 in the seal 32 and the four bores 79 in the auger bit 30 in a loose fitting relationship to permit axial motion of the control rods within the respective bores. Thus, as the rotating swash plate 66 is tilted about the spherical bearing 68, corresponding ones of the control linkages 72 and rods 74 are moved axially fore and aft within the bores 78 and 79. The control rods 74 also transmit rotation from the auger to the rotating swash plate 66 as the walls of the bores 79 push against the rods 74 as the bit 30 rotates.

As shown in FIG. 3, the control linkage rods 74 are attached to the steering tip 17 by way of a finger **74*a* projecting through a rod attachment bore 80. The finger 74*a* is permitted to pivot within the bore 80 as the steering tip 17 is tilted. The steering tip 17 includes a spherical bearing seat 86 that rides upon a spherical bearing 85 at the end of the drive shaft 35. The spherical bearing 85 is preferably threaded or splined onto the second threaded end 37 of the drive shaft. The steering tip 17 is free to pivot about the spherical bearing 85. The spherical bearing seat 86 of the steering tip defines a fluid cavity 87 into which fluid flows from the fluid channel 41 of the drive shaft 35. The steering tip 17 includes an orifice 88 projecting outward toward the end of the steering tip in fluid communication with the cavity 87. High pressure fluid flowing through the fluid line 23, fluid channel 41 and into the cavity 87 is ejected from the orifice 88** as a fluid jet to assist in the earth boring operation.

The heart of the present invention is essentially the steering control assembly 43 which includes the non-rotating mechanism 45, the rotating mechanism 65 and the control linkages 72. The non-rotating swash plate 56 operates as a cam while the rotating swash plate 66 serves as a cam-follower whereby tilting of the cam transmits a similar tilting motion to the follower. It can be seen that a full 360° range of tilting for the steering tip 17 is provided by two actuator linkage arms 54 and 57, and four control linkage arms 72. As previously described, the first and second linkage arms 54 and 57, respectively, are situated 90° apart, while the control linkages 72 are situated at 90° intervals around the circumference of the rotating swash plate 66. Actuation of one of the linkage arms 54 or 57 causes the non-rotating swash plate 46 and the rotating swash plate 66 to rotate about a single imaginary axis projecting through the spherical bearing 68. Simultaneous actuation of the first and second linkage arms permits tilting of the swash plates about axes that are not at a 90° interval to the first and second linkage arms. Varying degrees of actuation of the first and second linkage arms 54 and 57 provides varying degrees of tilt of the swash plates, which ultimately results in varying degrees of tilt of the steering tip 17. The steering tip is permitted to pivot about at least two non-colinear axes that are perpendicular to the longitudinal axis of the compaction auger. The steering tip is further permitted to pivot relative to the non-rotating housing about a full 360° cone to provide the maximum steering control possible.

Figure 7:
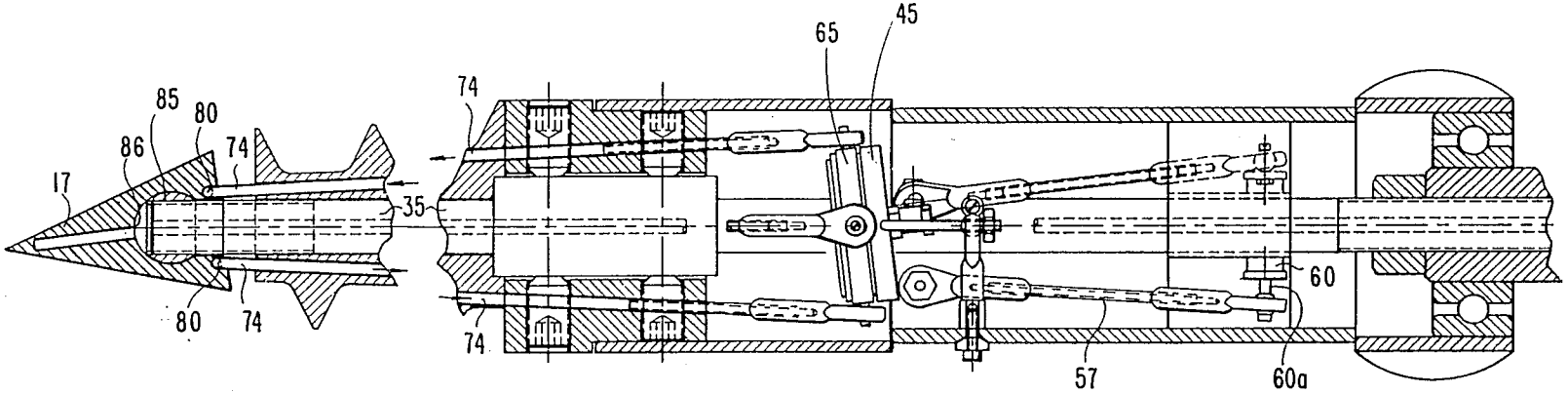
FIG. 7 is a partial cutaway cross-sectional view of the invention during a steering operation in which the steering tip is tilted.

In the preferred embodiment, the actuators 59 and 60 are electrical actuators in which the actuator rods **59*a* and 60*a*, respectively, project outward and perpendicular to the drive shaft 35. As the actuator rods are stroked, the linkage arms 54 and 57 are, in essence, pulled backward to tilt the non-rotating swash plate 46 about the end of the pivot arm 49. As shown in FIG. 7, actuation of the actuator 60 causes the rod 60*a* to stroke outwardly. The second linkage arm 57 is then pulled to the rear of the earth boring device as shown in the figure. When the second linkage arm 57 is pulled backwards, the entire non-rotating swash plate 46 pivots about an axis extending through the end of the pivot support rod 50, that is with respect to an axis extending from the page. Likewise, stroking only the first actuator 59 and moving only the first linkage arm 54 tilts or pivots the non-rotating swash plate 46 about an axis passing through the connection clevis 58** for the second linkage arm.

Figure 6:
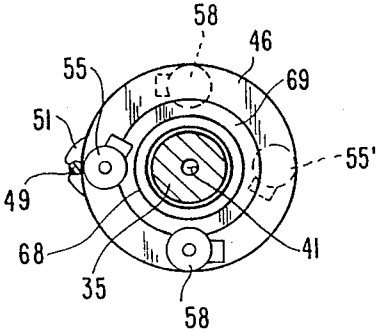
FIG. 6 is a rear view of the steering mechanisms shown in FIG. 4 as viewed in direction of the arrows of line 6—6.

While two linkage arms 54 and 57 are sufficient to provide a full 360° tilting of the steering tip 17, the addition of two more linkage arms and actuators may be provided. Thus, as shown in FIG. 6, a second actuator and linkage arm may be connected to the clevis 55' located 180° opposite the first clevis 55, and another clevis 58' may be provided 180° opposite the first clevis 55 for the second linkage arm. The additional linkage arms and actuators may be configured as a push type mechanism, rather than the pull type actuation provided by the actuators 59 and 60 as described.

It should be noted that the non-rotating swash plate 46 and the rotating swash plate 66 are essentially free floating, that is they are both free to pivot or move axially as required during steering maneuvering. The support rod 50 simply prevents the rotation of the non-rotating swash plate 46 due to frictional forces exerted by the rotating swash plate 66. The support rod 50 is permitted to move axially as required to accommodate the tilting motion of the non-rotating swash plate 46. However, the free floating motion of the rotating and non-rotating swash plates is restricted to some degree by the spherical bearing 68 and by the fixed lengths of the first and second linage arms 54 and 57 and the control linkage arms 72. The control linkage arms 72 tend to provide radial alignment for the rotating swash plate 66 relative to the non-rotating swash plate.

Figure 8:
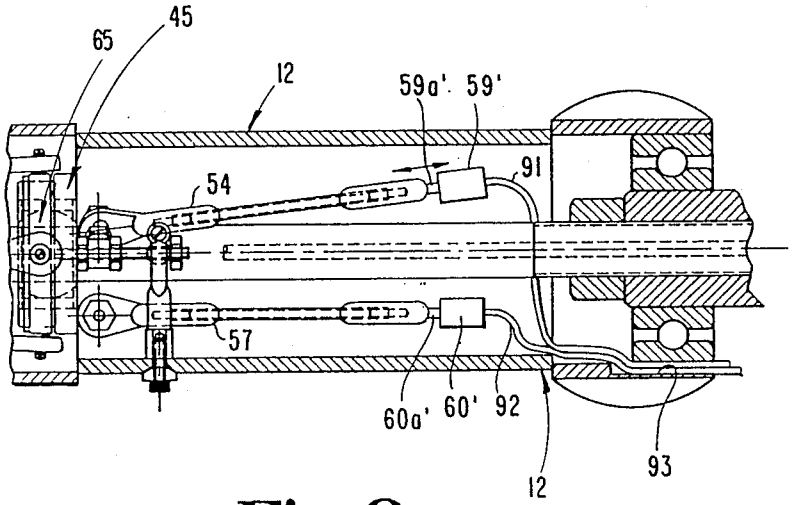
FIG. 8 is an enlarged partial cutaway cross-sectional view of an alternative embodiment of the present invention.

In an alternative embodiment of the invention, the electrical actuator is replaced by a hydraulic or pneumatic cylinder, as shown in FIG. 8. In this embodiment, the cylinders corresponding to the first and second linkage arms 54 and 57, repectively, include an generally axially aligned cylinder 59' and 60'. A rod **59*a*' and 60*a*' extends from the cylinder to provide the fore-aft motion of the linkage arms. In this embodiment, hydraulic lines 91 and 92 provide hydraulic fluid or air to the respective cylinders 59' and 60'. The lines 91 and 92 pass through a channel 93 cut into the non-rotating housing 12 directly outside the roller bearing 27. The hydraulic lines can be carried behind the steerable earth boring device 10 and connected directly to a source of hydraulic or pneumatic power. The first embodiment which employs the electric actuators 59 and 60 may also include electrical power lines passing through the channel 93 and connected to an above-ground electrical source. Alternatively, a separate individual power source, such as a battery, may be housed within the non-rotating housing assembly 12 to provide power directly to the actuators 59 and 60**.

In the preferred embodiment, most of the components of the steerable earth boring device are composed of a stainless steel. Preferably, however, the seal 32 is composed of a bronze material to provide a wear-resistant bearing surface for the rotation of the auger bit 30. Likewise, the spherical bearing 68 press-fit onto the shaft 35 can be composed of bronze, along with the bearing race 69 that rides upon the spherical bearing. Similarly, the spherical bearing 85 connected to the end of the drive shaft 35 can be composed of bronze to provide a smooth bearing surface for the motion of the spherical bearing seat 86 of the steering tip 17. The bronze spherical bearing 85 also provides a firm seal between the spherical bearing set 86 and the spherical bearing 85 when fluid is passing into the fluid cavity 87 of the steering bit 17. The non-rotating swash plate 46 may also be composed of a bronze material in order to improve the wear resistance of the drive flange 47 as the rotating swash plate 66 rotates thereon.

The simplicity of the mechanical steering control assembly 43 of the present invention permits the steerable earth boring device 10 to be reduced in size relative to the many of the earth boring devices of the prior art. In the preferred embodiment, the outer diameter of the non-rotating housing 12 is approximately 2 and one-half inches. The drive shaft 35 extending through the non-rotating housing and that provides rotational motion to the auger bit 30 has an outer diameter of one half inch. At low rotation speeds, the auger bit 30 operates to compact the soil surrounding the earth boring device 10, rather than drawing the soil back through the device. With this type of configuration, the rotation and steering components can be fully encased within the non-rotating housing and thereby protected from corrosive amd fouling effects of contact with the soil. If necessary, the fluid nozzle 88 can be used to inject a high pressure fluid to assist in the earth boring operation through more tightly packed soil. In many such operations, the fluid is provided at 800 PSI.

It can be seen from the foregoing that the steerable earth boring device of the present invention provides a simple and efficient method for boring a horizontal hole through the earth while providing efficient steering of the boring device. The components are relatively easily broken down and reassembled. The steering tip 17 is held in place by the drive shaft 35, which is itself connected to the input drive shaft 21. The auger bit 30 is axially restrained in one direction by the seal 32 riding against the non-rotating housing assembly 12, and in the opposite direction by the connections of the control linkages 72 and the first and second linkage arms 54 and 57 to the fixed actuators 59 and 60. In addition, the pivot support assembly 48 provides axial restraint for the non-rotating swash plate 46. Placement of the components can be facilitated by unthreading the drive shaft 35 from the input drive shaft 21 and removing the drive shaft, the auger bit 30, the seal 32 and the rotating mechanism 65.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A steerable earth boring device comprising:

a housing;

a compaction auger rotatably mounted to said housing at one end of said auger, said compaction auger being substantially externally exposed outside said housing;

a steering tip pivotably disposed beyond the other end of said compaction auger; and steering means for pivoting said steering tip relative to said compaction auger while said auger is rotating.

2. The steerable earth boring device of claim 1, wherein said housing includes a number of outwardly projecting fins adapted to resist rotation of said housing while said compaction auger is rotating.

3. The steerable earth boring device of claim 1, wherein said steering means includes:

a control member extending through and movable relative to said compaction auger, said control member having a first end and a second end, said first end being connected to said steering tip such that movement of said control member relative to said auger pivots said steering tip relative to said auger; and a steering control mechanism connected to said second end of said control member, said mechanism having means for moving said control member relative to said auger while said auger is rotating, thereby pivoting said steering tip.

4. The steerable earth boring device of claim 3, wherein:

said auger includes a bore extending therethrough; and said control member is a rod extending through and axially slidable within said bore.

5. The steerable earth boring device of claim 3, wherein:

said control member is rotatable with said auger; and said steering control mechanism includes:

a non-rotatable cam disposed within and pivotably connected to said housing;

means for pivoting said non-rotatable cam;

a rotatable follower disposed within said housing connected to said second end of said control member and rotatable with said control member, said rotatable follower being pivotable relative to said auger to move said control member relative to said auger; and means for transmitting pivoting motion of said non-rotating cam to said rotating follower.

6. The steerable earth boring device of claim 5, wherein:

said non-rotating cam is a first cylindrical swash plate having an inner circumferential bearing surface and longitudinally extending flange having an outer circumferential bearing surface;

said rotating follower is a second cylindrical swash plate having a second inner circumferential bearing surface disposed on said flange in bearing contact with said outer circumferential bearing surface; and said earth boring device further includes;

an elongated rotatable drive shaft extending through said housing and engaged adjacent one end of said drive shaft to said auger and at the other end of said drive shaft to a bendable drill string extending outside said housing; and a spherical bearing affixed to said drive shaft adjacent said cam and said follower; wherein said first and second swash plates are concentrically disposed about said drive shaft and said inner circumferential bearing surface of said first swash plate is in bearing contact with said spherical bearing.

7. The steerable earth boring device of claim 1, further comprising:

an elongated rotatable drive shaft extending through said housing and engaged adjacent one end of said drive shaft to said compaction auger and at the other end of said drive shaft to a bendable drill string extending outside said housing; and a cylindrical seal engaged on said drive shaft and disposed between said compaction auger and said housing, said seal including a bearing surface contacting said housing to permit rotation of said seal with said drive shaft relative to said housing.

8. The steerable earth boring device of claim 1, further comprising:

an elongated rotatable drive shaft extending entirely through said compaction auger and engaged adjacent one end of said drive shaft to said auger such that said one end of said drive shaft is disposed within said steering tip, and engaged at the other end of said drive shaft to a bendable drill string extending outside said housing;

a spherical bearing mounted on said one end of said drive shaft; and a spherical bearing seat formed in said steering tip to receive said spherical bearing therein to permit pivoting of said steering tip relative to said one end of said drive shaft while said drive shaft is rotating.

9. The steerable earth boring device of claim 8, further comprising a flexible shroud affixed between said other end of said compaction auger and said steering tip.

10. A steerable earth boring device comprising:

a housing;

an elongated auger rotatable about a longitudinal axis of said auger and rotatably mounted to said housing at one end of said auger;

a steering tip disposed at the other end of said auger and pivotable relative to said longitudinal axis of said auger; and steering means, disposed between said housing and said steering tip and extending through said auger, for pivoting said tip relative to said housing about at least two non-colinear axes perpendicular to said longitudinal axis, thereby pivoting said tip relative to said longitudinal axis.

11. The earth boring device of claim 1, further comprising;

a jet orifice at said steering tip; and means for providing high pressure fluid from said housing through said auger and said steering tip to said jet orifice to produce a fluid jet from said orifice.

12. The earth boring device of claim 10, further comprising:

a jet orifice at said steering tip; and means for providing high pressure fluid from said housing through said auger and said steering tip to said jet orifice to produce a fluid jet from said orifice.

* * * * *